US005496163A

United States Patent [19]

Griese et al.

[11] Patent Number: 5,496,163

[45] Date of Patent: Mar. 5, 1996

[54] GEAR MACHINE HAVING SHAFT TOOTHING FOR DRIVING A GEAR

[75] Inventors: Klaus Griese, Kupferzell; Guido Bredenfeld, Markgroeningen; Horst Hesse, Stuttgart, all of Germany

[73] Assignee: Robert Bosch GmbH, Stuttgart, Germany

[21] Appl. No.: 256,700

[22] PCT Filed: Jan. 18, 1994

[86] PCT No.: PCT/DE94/00033

§ 371 Date: Jul. 20, 1994

§ 102(e) Date: Jul. 20, 1994

[87] PCT Pub. No.: WO94/18455

PCT Pub. Date: Aug. 18, 1994

[30] Foreign Application Priority Data

Feb. 5, 1993 [DE] Germany ..... 43 03 337.7

[51] Int. Cl.[6] ..... F01C 1/18; F01C 11/00; F04C 2/18; F04C 11/00

[52] U.S. Cl. ..... 418/200; 418/206; 74/421 R

[58] Field of Search ..... 418/200, 206, 418/206.1; 74/421 R, 421 A

[56] References Cited

U.S. PATENT DOCUMENTS

| | | | |
|---|---|---|---|
| 1,014,150 | 1/1912 | Herrick | 418/200 |
| 4,293,290 | 10/1981 | Swanson | 418/206 |
| 4,699,575 | 10/1987 | Geisel et al. | 418/206 |
| 4,728,271 | 3/1988 | Harwath | 418/200 |

FOREIGN PATENT DOCUMENTS

| | | | |
|---|---|---|---|
| 1007959 | 2/1952 | France | 418/206 |
| 1021741 | 12/1952 | France | 418/200 |
| 2705249 | 10/1978 | Germany | 418/200 |
| 4024067 | 1/1992 | Germany | 418/206 |

*Primary Examiner*—John J. Vrablik
*Attorney, Agent, or Firm*—Michael J. Striker

[57] ABSTRACT

A gear machine (pump or motor) has two externally meshing gear pairs (21, 22) which are arranged so as to be offset relative to one another and are attached to a drive shaft (31) by a toothing (30), the number of teeth of the toothing (30) being an even-number multiple of the external teeth of the driven toothed wheels (16, 18). The toothing width (b) of the driven toothed wheels (16, 18) on the drive shaft (31) is smaller than their toothed wheel width (B), in particular smaller than one-half the toothed wheel width (B). This improves the mechanical characteristics of the gear machine its operating reliability. The invention can also be used with gear machines with only one gear pair (21*a*).

9 Claims, 3 Drawing Sheets

FIG. 2
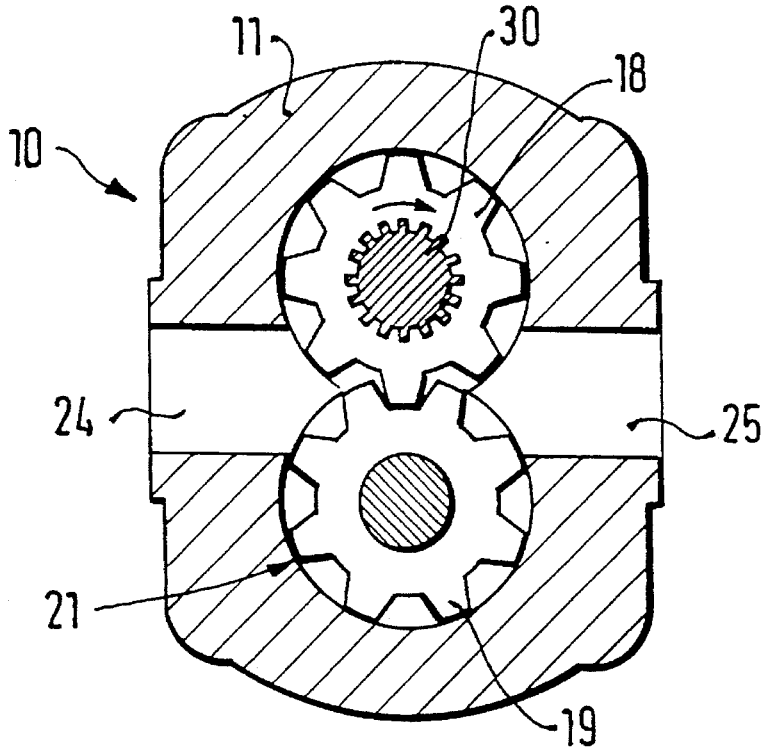
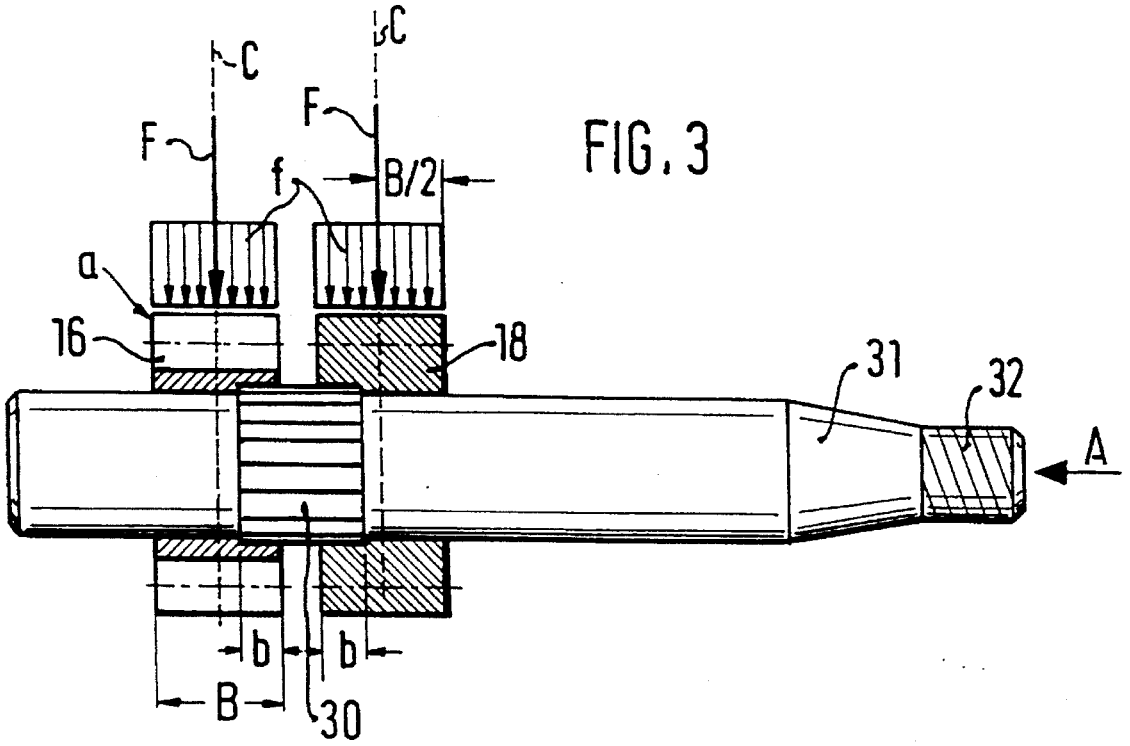
FIG. 3

GEAR MACHINE HAVING SHAFT TOOTHING FOR DRIVING A GEAR

BACKGROUND OF THE INVENTION

The present invention relates generally to a gear machine. In a prior gear machine known from DE-OS 27 05 249, the two toothed wheels arranged on a drive shaft are attached to the drive shaft by a gearing or toothing extending over the entire width of these toothed wheels. A disadvantage in this known gear machine consists in that axial forces passing into the drive shaft, e.g., such as those axial forces occurring in a gear machine driven via a helical-geared drive shaft, are transmitted to a front bearing via the relatively small end face of the toothing. The resulting high surface-area pressure causes a high degree of wear in this bearing. Further, for advantageous support of the toothed wheels on the drive shaft, the known gear machine requires a toothing with little radial clearance or play which raises the cost for manufacturing the toothing. The use of toothing with radial play causes an increase in the amount of chips occurring during the breaking-in period of the gear machine. Moreover, radial play in the toothing results in poor efficiency in the known gear machine owing to increased wear and friction work between the internal toothing of the toothed wheels and the external toothing of the drive shaft.

SUMMARY OF THE INVENTION

Accordingly, it is an object of the present invention to provide a gear machine of the above mentioned general type, which avoids the disadvantages of the prior art.

In keeping with these objects and with others which will become apparent hereinafter, one feature of the present invention resides, briefly stated, in a gear machine in which the toothing width of the driven toothed wheels is smaller than their toothed wheel width, the driven toothed wheels contact the end faces of the toothing in a positive locking manner via shoulders, the driven toothed wheels are arranged on the drive shaft so as to be free of radial play, the width of said additional toothing of said driven toothed wheel being smaller than one-half of said width of said external toothing, said driven toothed wheels being slidingly supported on said shaft and abutting against said drive shaft over a whole width of said driven toothed wheel which width is not covered by said external toothing.

When the gear machine is designed in accordance with the present invention, it has the advantage over the prior art that axial forces passing into the drive shaft are transmitted to the front bearing of the drive shaft along the entire end face of a driven toothed wheel. This reduces wear on this bearing. Further, it is particularly advantageous that the driven toothed wheels are guided on the drive shaft in the radial direction by a portion of their width so as to enable a simple connection without radial play with corresponding dimensional tolerances between the toothed wheel and drive shaft. This reduces wear in the toothing. Since the toothing serves only to transmit the driving torque to the toothed wheels, it is possible to use tooth shapes which can be produced inexpensively.

Also, when the gear machine is designed in accordance with the present invention, the hydraulic forces occurring in operation are transmitted by the toothed wheels to the drive shaft in such a way that no tilting moments occur, thus improving the operation of the gear machine.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 shows a cross section in direction II—II according to FIG. 1;

FIG. 3 shows another cross section through a drive shaft and toothed wheels in direction III—III according to FIG. 1;

DESCRIPTION OF THE PREFERRED EMBODIMENTS

Figure 1:
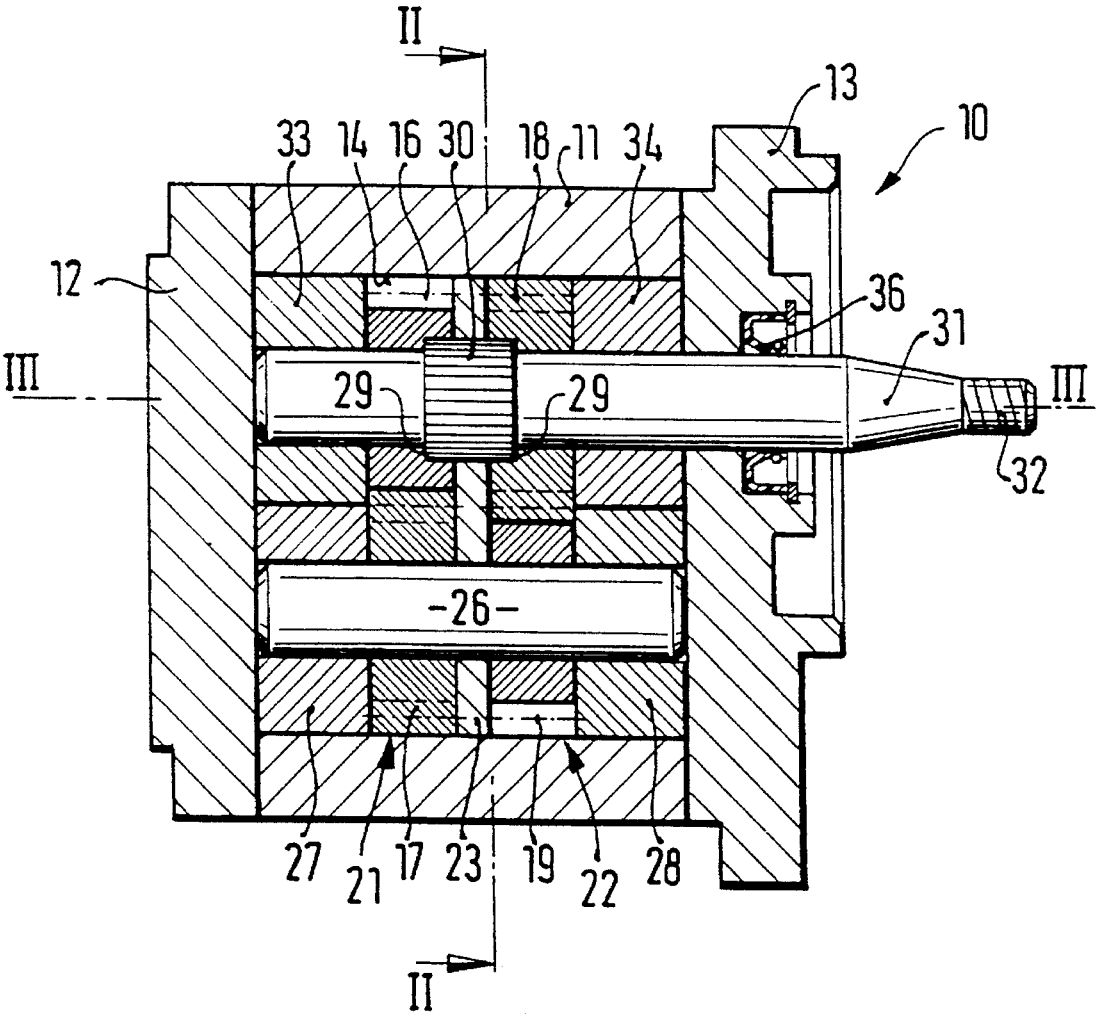
FIG. 1 shows a longitudinal section through a dual-gear pump.

A dual-gear pump 10 has a housing 11 which is terminated at the respective end sides by a base plate 12 and an end plate 13. A continuous recess 14 is formed in the housing 11, the toothed wheels 16, 17, 18 and 19 being arranged therein. The toothed wheels 16 and 17, respectively, 18 and 19 which mesh with one another externally form gear pairs 21 and 22. The gear pairs 21 and 22 are separated by an intermediate plate 23. Accordingly, there are two separate transmitting units with a common suction space 24 and pressure space 25. The toothed wheels 17 and 19 are arranged on a shaft 26 which is supported in bearing members 27 and 28. The driven toothed wheels 16 and 18 are fastened by a toothing 30 in the region of the intermediate plate 23 on the drive shaft 31 so as to be fixed with respect to rotation relative thereto. The driven toothed wheels 16 and 18 contact steps or shoulders 29 at the respective end faces of the toothing 30 in a positive engagement. The drive shaft 31 is driven by a motor, not shown, via a helical toothing 32 and is supported in a bearing member 33 on the base plate side and in a bearing member 34 on the end plate side. A seal 36 ensures that the drive shaft 31 is sealed relative to the end plate 13. The pressure pulses occurring during operation of the pump can be reduced when the number of teeth of the toothing 30 is an even-number multiple of the number of teeth of the driven toothed wheels 16 and 18, the gear pairs 21 and 22 being offset relative to one another by one-half the tooth pitch. The toothing width b of the driven toothed wheels 16 and 18 on the drive shaft 31 is advantageously smaller than one-half the toothed wheel width B. The dimensional tolerance between the bore hole of the region of the driven toothed wheels 16 and 18 which is not provided with teeth and the outer diameter of the region of the drive shaft 31 which is not provided with teeth is selected in such a way that the driven toothed wheels 16 and 18 can be slidingly mounted on the drive shaft 31 without radial play.

When the toothed wheels 16 and 18 are rotated, e.g., in the clockwise direction, by the drive shaft 31, the complementary toothed wheels 17 and 19 move in the counterclockwise direction and a pressure medium which is sucked in via the suction space 24 is conveyed into in the tooth spaces accompanied by a build-up of pressure in the pressure space 25. Uniformly large hydraulic forces f occur along the entire width B of the toothed wheel. These forces f can be replaced by forces F acting in the lines of action C of the respective toothed wheels 16 and 18. The lines of action C extend vertically to the axis of the toothed wheels midway along the width B of the toothed wheels and press the driven toothed wheels 16 and 18 in the direction of the suction space 24 on the drive shaft 31. Since the toothing width b is smaller than one-half the width B of the toothed wheel, the forces F do not act within the toothing width b and there is accordingly no tilting of the respective toothed wheel 16 and 18 relative to the drive shaft 31. Since the driven toothed wheels 16 and 18 are attached to the drive shaft 31 so as to be free of radial play, there is no relative movement between the driven toothed wheels 16 and 18 and the drive shaft 31 in the toothing 30 and wear is accordingly reduced. An axial force A transmitted via the helical-toothed drive shaft 31 is transmitted to the bearing member 33 on the base plate side via one shoulder 29 of the driven toothed wheel 16 and its entire end face a. The life of the bearing member 33 is accordingly increased. This is also true in a corresponding manner for the bearing member 34 when the force A acts as a tensile force in the other direction in the drive shaft 31.

Figure 4:
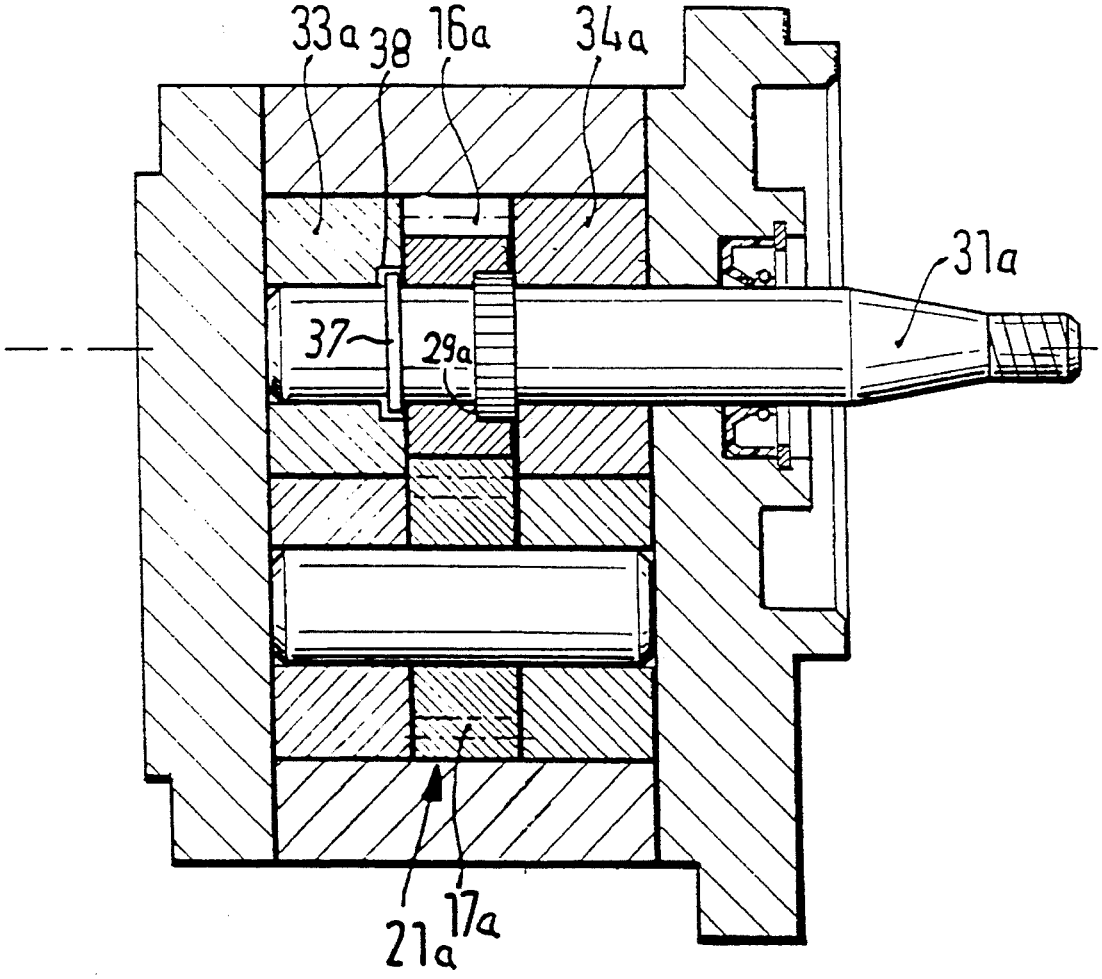
FIG. 4 shows a longitudinal section through a gear pump with a pair of toothed wheels.

In another embodiment example of the invention (FIG. 4), the gear pump only has one gear pair 21 a with a driven toothed wheel 16*a* and a toothed wheel 17*a* which is not driven. The toothed wheel 16*a* is secured on the drive shaft 31*a* in the axial direction by a snap ring or spring ring 37. Further, the spring ring 37 engages in a groove formed in the drive shaft 31*a*. The spring ring 37 is arranged in a cut out portion or recess 38 in the bearing member 33*a* without contacting the wall of the recess 38, this recess 38 being open toward the toothed wheel 16*a*. When the drive shaft 31*a* is acted upon by tensile force, the spring ring 37 ensures that the tensile force is transmitted to the bearing member 34*a* via the entire end face of the toothed wheel 16*a*. In other respects, this embodiment form shares the features and advantages described above with respect to the dual-gear pump 10.

We claim:

1. A gear machine, comprising a drive shaft; at least one pair of externally meshing toothed wheels including a driven toothed wheel which is driven by said shaft and a complementary toothed wheel, each of said toothed wheels having an external toothing engaging with an external toothing of another of said toothed wheels, said driven toothed wheel having an additional toothing engaging with said drive shaft, said additional toothing of said driven toothed wheel having a width which is smaller than a width of said external toothing of said driven toothed wheel, said drive shaft having an additional toothing meshing with said additional toothing of said driven toothed wheel and having a shoulder, said driven toothed wheel contacting said shoulder of said additional toothing of said drive shaft in a positive-working manner, said driven toothed wheel being arranged on said drive shaft so as to be free of radial play, the width of said additional toothing of said driven toothed wheel being smaller than one-half of said width of said external toothing, said driven toothed wheel being slidingly supported on said shaft and abutting against said drive shaft over a whole width of said driven toothed wheel not covered by said additional toothing.

2. A gear machine as defined in claim 1, wherein said additional toothing of said driven toothed wheel has a number of teeth which is an even-number multiple of the number of teeth of said external toothing of said driven toothed wheel.

3. A gear machine as defined in claim 1; and further comprising an additional pair of externally meshing toothed wheels each having an external toothing meshing with one another and one of said additional meshing toothed wheels being driven and having an additional toothing meshing with an additional toothing of said drive shaft, said additional toothing of said driven toothed wheel of said additional pair having a width which is smaller than a width of said external toothing of said driven toothed wheel of said additional pair, said additional toothing of said drive shaft having an additional shoulder which is contacted by said driven toothed wheel of said additional pair in a positive-locking manner, said driven toothed wheel of said additional toothed wheel pair being arranged on said drive shaft so as to be free of radial play by abutting against said drive shaft over a width not covered by said additional toothing.

4. A gear machine as defined in claim 3; and further comprising an intermediate plate which separates said toothed wheel pairs from one another.

5. A gear machine as defined in claim 3, wherein said width of each of said additional toothing is smaller than one-half of said width of said external toothing of each of said wheels.

6. A gear machine as defined in claim 3, wherein said additional toothing has a number of teeth which is an even-number multiple of a number of teeth of said external toothing of each of said driven toothed wheels.

7. A gear machine as defined in claim 1; and further comprising a retaining element which secures said driven toothed wheel on said drive shaft in an axial direction.

8. A gear machine as defined in claim 7; and further comprising a bearing member provided with a recess, said retaining element being arranged in said recess of said bearing member.

9. A gear machine, comprising a drive shaft; at least one pair of externally meshing toothed wheels including a driven toothed wheel which is driven by said shaft and a complementary toothed wheel, each of said toothed wheels having an external toothing engaging with an external toothing of another of said toothed wheels, said driven toothed wheel having an additional toothing engaging with said drive shaft, said additional toothing of said driven toothed wheel having a width which is smaller than a width of said external toothing of said driven toothed wheel, said drive shaft having an additional toothing meshing with said additional toothing of said driven toothed wheel and having a shoulder, said driven toothed wheel contacting said shoulder of said additional toothing of said drive shaft in a positive-working manner, said driven toothed wheel being arranged on said drive shaft so as to be free of radial play; an additional pair of externally meshing toothed wheels each having an external toothing meshing with one another and a driven toothed wheel of said additional pair having an additional toothing meshing with an additional toothing of said drive shaft, said additional toothing of said driven toothed wheel of said additional pair of toothed wheels having a width which is smaller than a width of said external toothing of said driven toothed wheel of said additional pair, said additional toothing of said drive shaft having an additional shoulder which is contacted by said driven toothed wheel of said additional pair in a positive-locking manner, said driven toothed wheel of said additional toothed wheel pair being arranged on said drive shaft so as to be free of radial play, the width of said additional toothing of said driven toothed wheel of said additional pair being smaller than one-half of said width of said external toothing of said driven toothed wheel of said additional pair, said driven toothed wheels being slidingly supported on said shaft and abutting against said drive shaft over a whole width of said driven toothed wheels not covered by said additional toothing. drive shaft over a width not covered by said additional toothing

* * * * *